US006615014B2

(12) United States Patent
Sugihara

(10) Patent No.: US 6,615,014 B2
(45) Date of Patent: Sep. 2, 2003

(54) METHOD AND APPARATUS FOR IMAGE FORMING CAPABLE OF PERFORMING AN EFFECTIVE MIXING OF DEVELOPMENT AGENT

(75) Inventor: Kazuyuki Sugihara, Kanagawa-ken (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 09/802,953

(22) Filed: Mar. 12, 2001

(65) Prior Publication Data

US 2001/0021324 A1 Sep. 13, 2001

(30) Foreign Application Priority Data

Mar. 10, 2000 (JP) ..... P2000-067513

(51) Int. Cl.[7] ..... G03G 15/08
(52) U.S. Cl. ..... 399/254; 399/286
(58) Field of Search ..... 399/119, 254, 399/256, 258, 262, 263; 366/279, 292, 294, 318, 319, 320

(56) References Cited

U.S. PATENT DOCUMENTS

| | | | |
|---|---|---|---|
| 4,975,748 | A | 12/1990 | Koinuma et al. |
| 5,105,226 | A | 4/1992 | Sugihara |
| 5,172,169 | A | 12/1992 | Takashima et al. |
| 5,239,344 | A | 8/1993 | Enoki et al. |
| 5,286,918 | A | 2/1994 | Iwata et al. |
| 5,311,263 | A | 5/1994 | Suzuki et al. |
| 5,384,628 | A | 1/1995 | Takami et al. |
| 5,389,733 | A | 2/1995 | Enoki et al. |
| 5,508,794 | A | 4/1996 | Ikesue et al. |
| 5,552,877 | A | 9/1996 | Ishikawa et al. |
| 5,617,198 | A | 4/1997 | Ishikawa et al. |
| 5,627,630 | A | 5/1997 | Matsumae et al. |
| 5,646,721 | A | 7/1997 | Sugihara et al. |
| 5,657,115 | A | 8/1997 | Sugihara |
| 5,671,470 | A | 9/1997 | Maruta et al. |
| 5,674,408 | A | 10/1997 | Suzuki et al. |
| 5,741,616 | A | 4/1998 | Hirano et al. |
| 5,758,235 | A | 5/1998 | Kosuge et al. |
| 5,761,576 | A | 6/1998 | Sugihara et al. |
| 5,765,059 | A | 6/1998 | Kosuge et al. |
| 5,768,664 | A | 6/1998 | Kosuge et al. |
| 5,784,669 | A | 7/1998 | Miura et al. |
| 5,787,328 | A | 7/1998 | Sugihara et al. |

(List continued on next page.)

FOREIGN PATENT DOCUMENTS

JP 11-202627 7/1999

OTHER PUBLICATIONS

U.S. patent application Ser. No. 09/576,440, filed May 22, 2000, pending.
U.S. patent application Ser. No. 09/802,953, filed Mar. 12, 2001, pending.

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a development mechanism using a two-component development agent and which includes a development roller and first and second transfer screws. The first transfer screw, arranged at a position approximately horizontal and in parallel to the development roller, includes a first number of screw spirals for transferring the development agent from a first end to a second end of the first transfer screw and conveying the development agent to the development roller. The second transfer screw, arranged approximately horizontal and in parallel to the first transfer screw, includes a second number of screw spirals for transferring the development agent from a first end to a second end of the second transfer screw and conveying the development agent from the second end of the second transfer screw to the first end of the first transfer screw. The first and second numbers of the screw spirals are different from each other.

15 Claims, 6 Drawing Sheets

U.S. PATENT DOCUMENTS

| | | | | |
|---|---|---|---|---|
| 5,826,146 | A | | 10/1998 | Maruta et al. |
| 5,850,586 | A | | 12/1998 | Sugihara et al. |
| 5,915,155 | A | | 6/1999 | Shoji et al. |
| 5,940,664 | A | | 8/1999 | Sugihara et al. |
| 5,956,549 | A | | 9/1999 | Sugihara et al. |
| 5,970,276 | A | | 10/1999 | Kato |
| 5,991,569 | A | | 11/1999 | Sugihara et al. |
| 6,070,037 | A | | 5/2000 | Sugihara et al. |
| 6,072,967 | A | | 6/2000 | Sugihara et al. |
| 6,081,678 | A | | 6/2000 | Kato |
| 6,104,900 | A | | 8/2000 | Ishikawa et al. |
| 6,122,469 | A | | 9/2000 | Miura et al. |
| 6,122,472 | A | * | 9/2000 | Sako et al. ..... 399/254 |
| 6,125,243 | A | | 9/2000 | Shoji et al. |
| 6,141,520 | A | | 10/2000 | Kosuge |
| 6,226,481 | B1 | | 5/2001 | Yoneda et al. |
| 6,281,961 | B1 | * | 8/2001 | Sako et al. ..... 399/254 |

* cited by examiner

METHOD AND APPARATUS FOR IMAGE FORMING CAPABLE OF PERFORMING AN EFFECTIVE MIXING OF DEVELOPMENT AGENT

BACKGROUND OF THE INVENTION

1. Field of the Invention

The present invention relates to a method and apparatus for image forming, and more particularly to a method and apparatus for image forming that can perform an effective mixing of development agent.

2. Discussion of the Background

In a recent background image forming apparatus shown in FIG. 1, a development mechanism using a two-component development agent typically includes a development roller 5, and transfer screws 6 and 7 for transferring the development agent inside a housing (not shown) of the development mechanism arranged adjacent to an image carrying member 12. In this type of the two-component development mechanism, the transfer screws 6 and 7 are arranged in parallel to each other and one of the two is placed close to and in parallel to the development roller 5 in the width direction thereof. The other of the two is placed farther from, and in parallel to, the development roller 5 in the width direction thereof. The development agent is circulated using the thus-configured two transfer screws 6 and 7.

The transfer screws 6 and 7 perform mixture and transfer of the development agent in a superior manner in a direction X in parallel to a length direction of the development roller 5. However, the transfer of the development agent in a direction Y orthogonal to the length direction of the development roller 5 is not performed in a manner as good as that performed in the direction X.

Accordingly, the transfer screw 6 arranged closer to the development roller 5 is prone to cause an uneven density in a form of a screw pitch when a great amount of toner is being supplied. Particularly, in a color copying machine, the uneven density appears as an unevenness of color and therefore it greatly reduces image quality.

SUMMARY OF THE INVENTION

The present invention provides a novel image forming apparatus. In one example, a novel image forming apparatus includes a development mechanism using a two component development agent and which includes a development roller and first and second transfer screws. The first transfer screw includes a first number of screw spirals for transferring the development agent from a first end of the first transfer screw to a second end of the first transfer screw and conveying the development agent to the development roller. The first transfer screw is arranged approximately horizontal and in parallel to the development roller. The second transfer screw includes a second number of screw spirals for transferring the development agent from a first end of the second transfer screw to a second end of the second transfer screw and conveying the development agent from the second end of the second transfer screw to the first end of the first transfer screw. The second transfer screw is arranged approximately horizontal and in parallel to the first transfer screw. In this development mechanism, the first and second numbers of the screw spirals are different from each other.

The first number of the screw spirals may be greater than the second number of screw spirals.

The first transfer screw may have a first spiral pitch which is greater than a second spiral pitch of the second transfer screw.

In the above-mentioned image forming apparatus, when the first and second transfer screws have spiral diameters equal to each other and shaft diameters equal to each other, the first and second transfer screws may satisfy relationships of:

$$P1 \geqq 1.5 \times P2; \text{ and}$$

$$S1 \geqq 4 \times S2,$$

wherein P1 and S1 represent the first spiral pitch and the first screw spirals, respectively, of the first transfer screw and P2 and S2 represent the second spiral pitch and the second screw spirals, respectively, of the second transfer screw.

The first and second transfer screws may be rotated in directions different from each other.

The present invention further provides a novel method of transferring development agent. In one example, a novel method includes the steps of providing, placing, rotating, and reverse rotating. The providing step provides a first transfer screw at a position approximately horizontal and in parallel to a development roller. The first transfer screw has a first number of screw spirals. The placing step places a second transfer screw at a position approximately horizontal and in parallel to the first transfer screw. The second transfer screw has a second number of screw spirals in parallel to the first transfer screw. In this case, the second number of screw spirals is different from the first number of screw spirals. The rotating step rotates the first transfer screw. The reverse rotating step rotates the second transfer screw in a reverse direction relative to the rotation of the first transfer screw to transfer the development agent in a direction from a first end of the second transfer screw to a second end of the second transfer screw and in a direction from the second transfer screw to the first transfer screw so that the development agent is consequently transferred by the first transfer screw in a direction from a first end of the first transfer screw to a second end of the first transfer screw and in a direction from the first transfer screw to the development roller.

The first number of the screw spirals may be greater than the second number of the screw spirals.

The first transfer screw may be a first spiral pitch which is greater than a second spiral pitch of the second transfer screw.

In the above-mentioned method, when the first and second transfer screws have spiral diameters equal to each other and shaft diameters equal to each other, the first and second transfer screws satisfy relationships of:

$$P1 \geqq 1.5 \times P2; \text{ and}$$

$$S1 \geqq 4 \times S2,$$

wherein P1 and S1 represent the first spiral pitch and the first screw spirals, respectively, of the first transfer screw and P2 and S2 represent the second spiral pitch and the second screw spirals, respectively, of the second transfer screw.

The first and second transfer screws may be rotated in directions different from each other.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
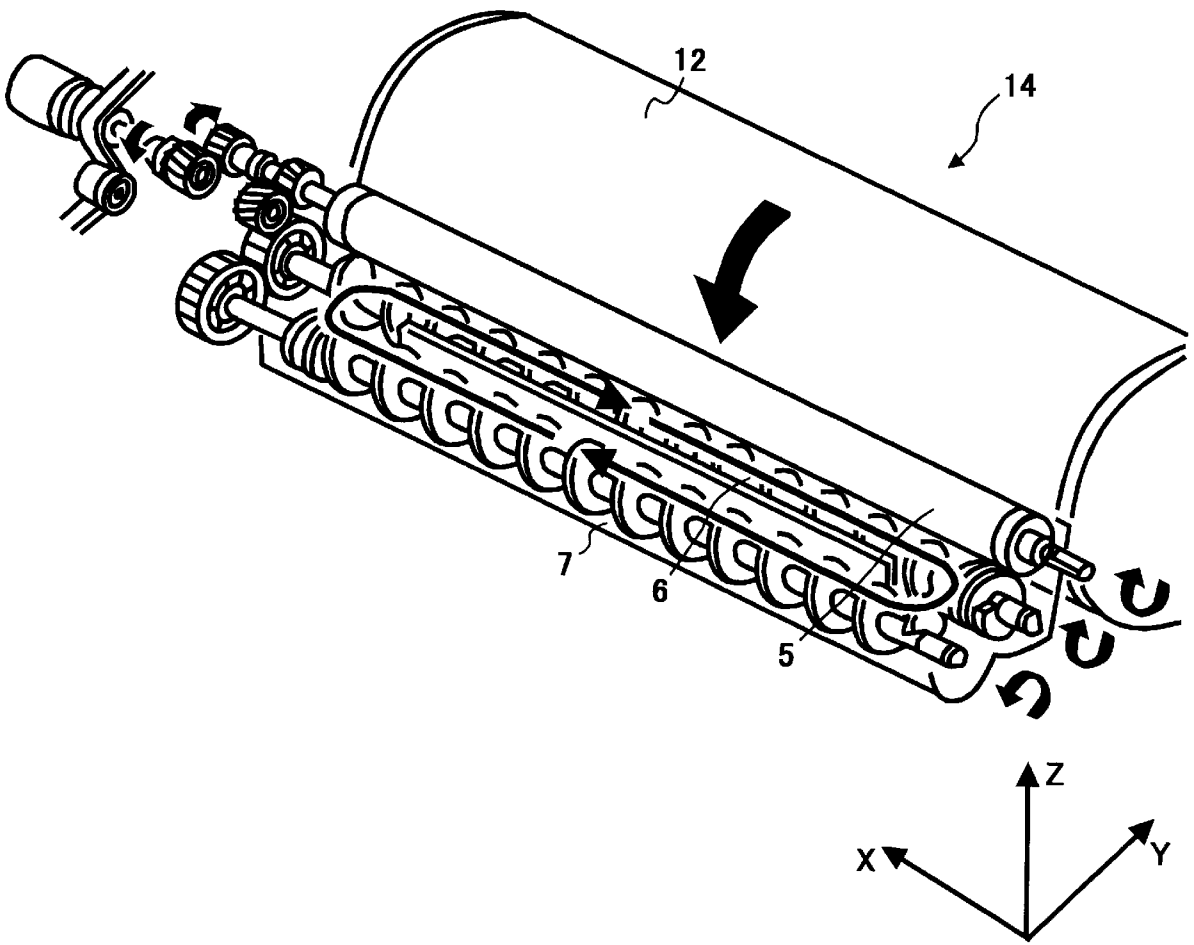
FIG. 1 BACKGROUND ART
FIG. 1 is a perspective schematic view of a background development mechanism used in an image forming apparatus.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Figure 2:
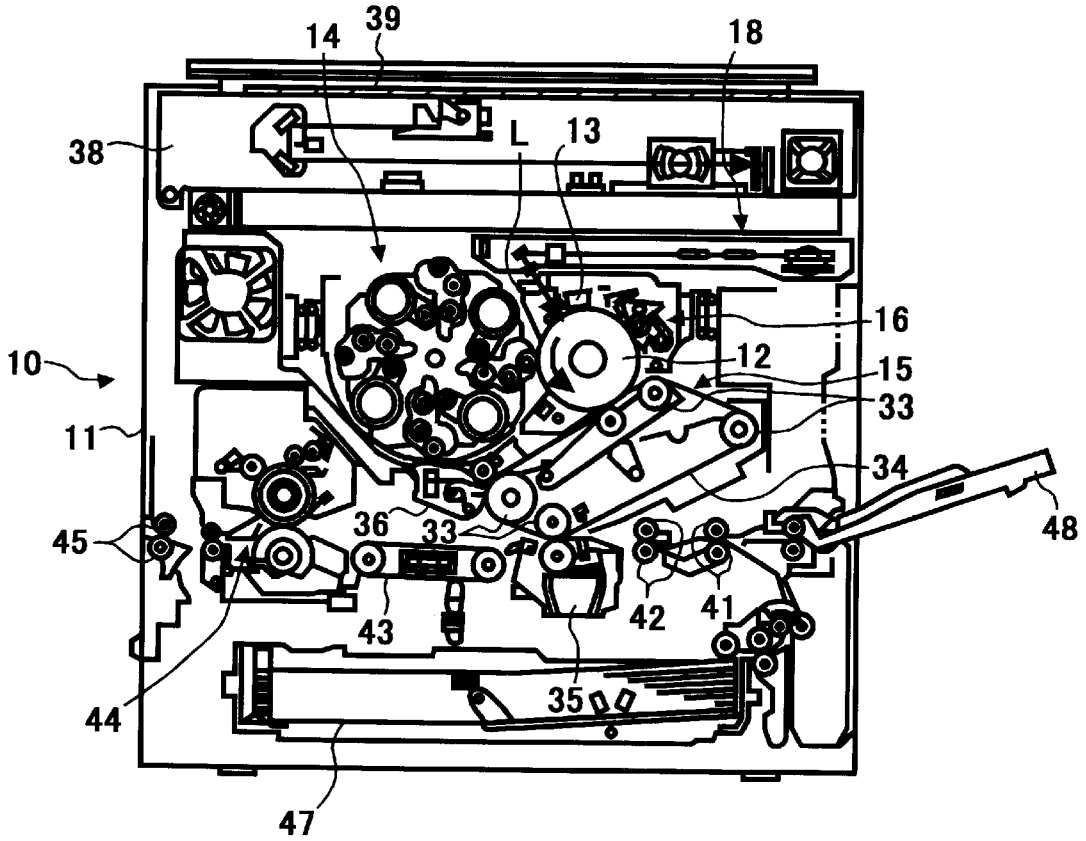
FIG. 2 is a schematic cross-sectional side view of a color image forming apparatus according to an embodiment of the present invention.

Referring now to the drawings, wherein like reference numerals designate identical or corresponding parts throughout the several views, particularly to FIG. 2, a color image forming apparatus 10 according to an embodiment of the present invention is described. In FIG. 2, the color image forming apparatus 10 is provided with a drum-shaped image carrying member 12 arranged at a position slightly right from the center inside an exterior housing 11. A charger 13 is arranged above the image carrying member 12. From the charger 13, a revolving development station 14, an intermediate transfer unit 15, and a cleaning unit 16 are arranged around the image carrying member 12 in this order in a counterclockwise direction. A laser writing unit 18 is arranged above the charger 13, the revolving development station 14, and the cleaning unit 16.

Figure 3:
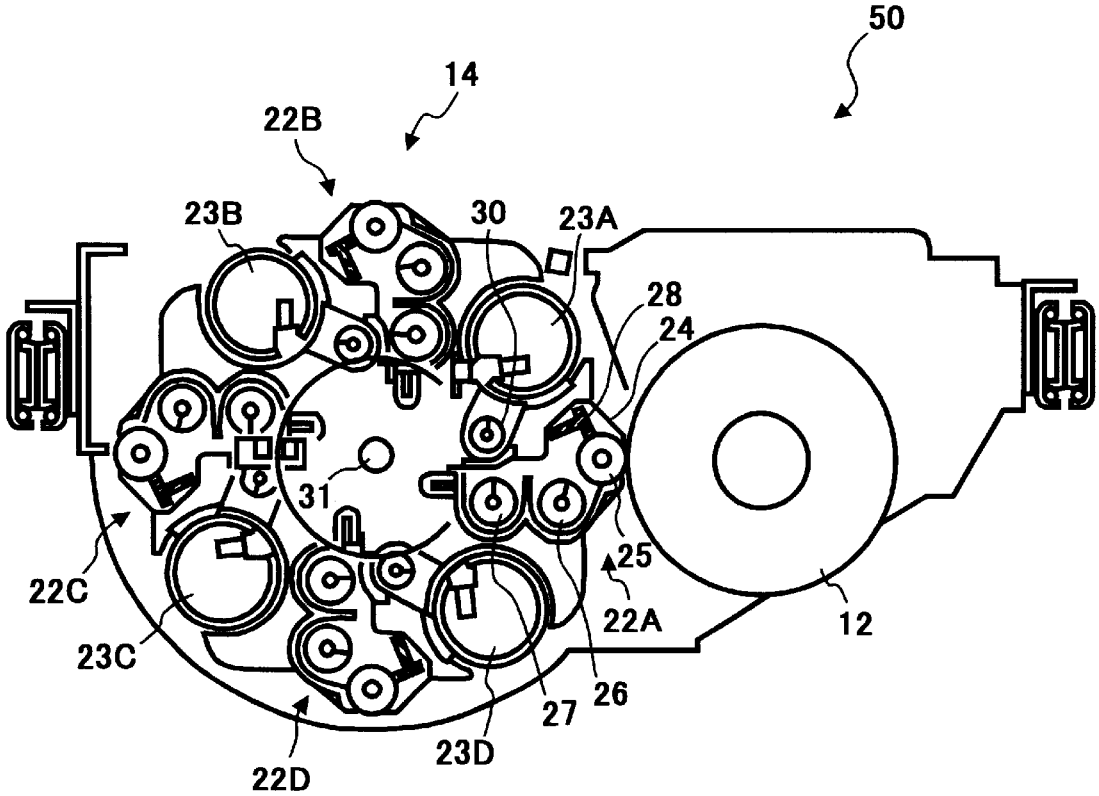
FIG. 3 is a schematic cross-sectional side view showing a multi-color development section of the color image forming apparatus of FIG. 1.

The revolving development station 14 includes, as shown in FIG. 3, development units 22*a*, 22*b*, 22*c*, and 22*d* that develop yellow, magenta, cyan, and black toner images, respectively, and toner cartridges 23*a*, 23*b*, 23*c*, and 23*d* that contain yellow, magenta, cyan, and black toner, respectively.

Each of the development units 22*a*–22*d* includes a development case 24 and, inside the development case 24, a development roller 25, a first transfer screw 26, a second transfer screw 27, and a development doctor 28. The toner in a chamber of the second transfer screw 27 is transferred by the second transfer screw 27 into a chamber of the first transfer screw 26 and is then transferred by the first transfer screw 26 to the development roller 25. The development doctor 28 regulates a thick toner layer deposited on the surface of the development roller 25 into a thin uniform toner layer.

Each of the toner cartridges 23*a*–23*d* is detachably mounted to a cartridge guide (not shown) to which a toner supply screw 30 is provided so that the toner supply screw 30 sends the toner in the corresponding toner cartridge into the development case 24.

The thus-arranged revolving development station 14 is rotated about a center axis 31 provided at a center of a development supporting member (not shown) so that the development rollers of the development units 22*a*–22*d* selectively face the circumferential surface of the image carrying member 12.

As shown in FIG. 2, the intermediate transfer unit 15 includes an endless-belt-shaped intermediate transfer member 34 extended around a plurality of rollers 33. A part of the intermediate transfer member 34 is in contact with the image carrying member 12. Around the intermediate transfer member 34 are provided a transfer unit 35 and a belt cleaning unit 36. The belt cleaning unit 36 is movably mounted so that it can be attached and detached.

The laser writing unit 18 generates laser light L and uses it to write an image in accordance with data obtained with an optical reading unit 38. As a result, an electrostatic latent image is formed on the surface of the image carrying member 12. The optical reading unit 38 reads an original placed on a contact glass 39 provided at a top portion of the color image forming apparatus 10.

As shown in FIG. 2, the color image forming apparatus 10 further includes a plurality of feed rollers 41, a pair of registration rollers 42, a feed belt 43, a fixing unit 44, a pair of ejection rollers 45, a pair of ejection rollers 45, a recording media cassette 47, and a manual insertion tray 48. The plurality of feed rollers 41 and the pair of registration rollers 42 are arranged upstream from the intermediate transfer unit 15 and the transfer unit 35 in a sheet direction along a transfer path (not shown) for transferring a recording media. The feed belt 43, the fixing unit 44, and the pair of ejection rollers 45 are arranged downstream from the intermediate transfer unit 15 and the transfer unit 35 in the sheet direction along the transfer path.

To reproduce a color image on the above-described color image forming apparatus 10, a start switch (not shown) provided thereto is pressed after an original is first placed on the contact glass 39, and a recording media sent from the recording media cassette 47 is guided to the above-mentioned transfer path via an automatic sheet feeding unit (not shown) or a recording media placed in the manual insertion tray 48 is sent to the transfer path via a manual feed path (not shown). Then, the recording media is transferred to the registration rollers 42 by the transfer rollers 41.

During the above-mentioned process, the optical reading unit 38 is activated to scan the surface of the original placed on the contact glass 39 so as to read the image of the original. Also, as the image carrying member 12 is rotated in the counterclockwise direction in FIG. 2, the intermediate transfer member 34 is rotated in the clockwise direction with the rotation of the plurality of rollers 33. During the rotation of the image carrying member 34, the surface thereof is evenly charged with the charger 13 and is exposed to the laser light L emitted in accordance with the information read by the optical reading unit 38 so that an electrostatic latent image representing the first color is formed on the image carrying member 12.

Then, the above first color latent image is visualized with toner by the development unit 22*a* that contains the first color toner so that the first color image is formed on the image carrying member 12. This mono-color toner image is transferred onto the intermediate transfer member 34 of the intermediate transfer unit 15. After the transfer process, the surface of the image carrying member 12 is discharged with a precleaning charger (not shown) for increasing the cleaning effect and the residual first color toner is cleaned by the cleaning unit 16. After that, the surface of the image carrying member 12 is again discharged with a pre-charging discharger (not shown).

The image carrying member 12 continues to be rotated for the second rotation, and the surface thereof is evenly charged with the charger 13 for the second time. The second color electrostatic latent image is written on the surface of the image carrying member 12 and the second color latent image is visualized with toner by the development unit 22*b* that contains the second color toner so that the second color image is formed on the image carrying member 12. This mono-color toner image is transferred onto the intermediate transfer member 34 of the intermediate transfer unit 15 such that the first mono-color toner image is overlaid by the second mono-color toner image. After such transfer process, the surface of the image carrying member 12 is cleaned after the pre-cleaning discharging and is again discharged.

In a way similar to the above, the third mono-color toner image is formed on the surface of the image carrying member 12 and is transferred onto the intermediate transfer member 34. If a black toner image is required, it is also formed on the surface of the image carrying member 12 and is transferred onto the intermediate transfer member 34. In this way, a combined color image is consequently formed in accordance with the information read from the original on the intermediate transfer member 34.

After that, the registration rollers 42 are rotated in synchronism with the rotation of the intermediate transfer member 34 so that the recording media which is stopped by the registration rollers 42 is advanced to the intermediate transfer unit 15 and the transfer unit 35. The color image conveyed on the intermediate transfer member 34 is transferred onto the recording media. The recording media having the color image thereon is moved to the fixing unit 44 by the feed belt 43 and the color image is fixed on the recording media with heat and pressure by the fixing unit 44. After the fixing process, the recording media is ejected by the ejection rollers 45 to an ejection tray (not shown) in which the recording media is stacked one after another.

After the transfer process, the intermediate transfer member 34 is cleaned by the belt cleaning unit 36 so that the residual toner deposited on the surface of the intermediate transfer member 34 is removed and the surface of the intermediate transfer member 34 is discharged by a discharging unit (not shown).

FIG. 3 shows a multi-color development section 50 including the above-described revolving development station 14. The multi-color development section 50 is movably mounted in the color image forming apparatus 10 so that the revolving development station 14 can be pulled out from the exterior housing 11. That is, when the multi-color development section 50 is pulled out from the exterior housing 11, the revolving development station 14 can be moved at an accessible position at which each of the development units 22*a*–22*d* can be removed.

As described above, the development roller 25, the first and second transfer screws 26 and 27, and the development doctor 28 are included in each of the development units 22*a*–22*d*. The development roller 25 includes a magnet roller and a development sleeve, both which are not shown. The development agent including a magnetic carrier is conveyed by a rotation of the development sleeve of the development roller 25.

Figure 4:
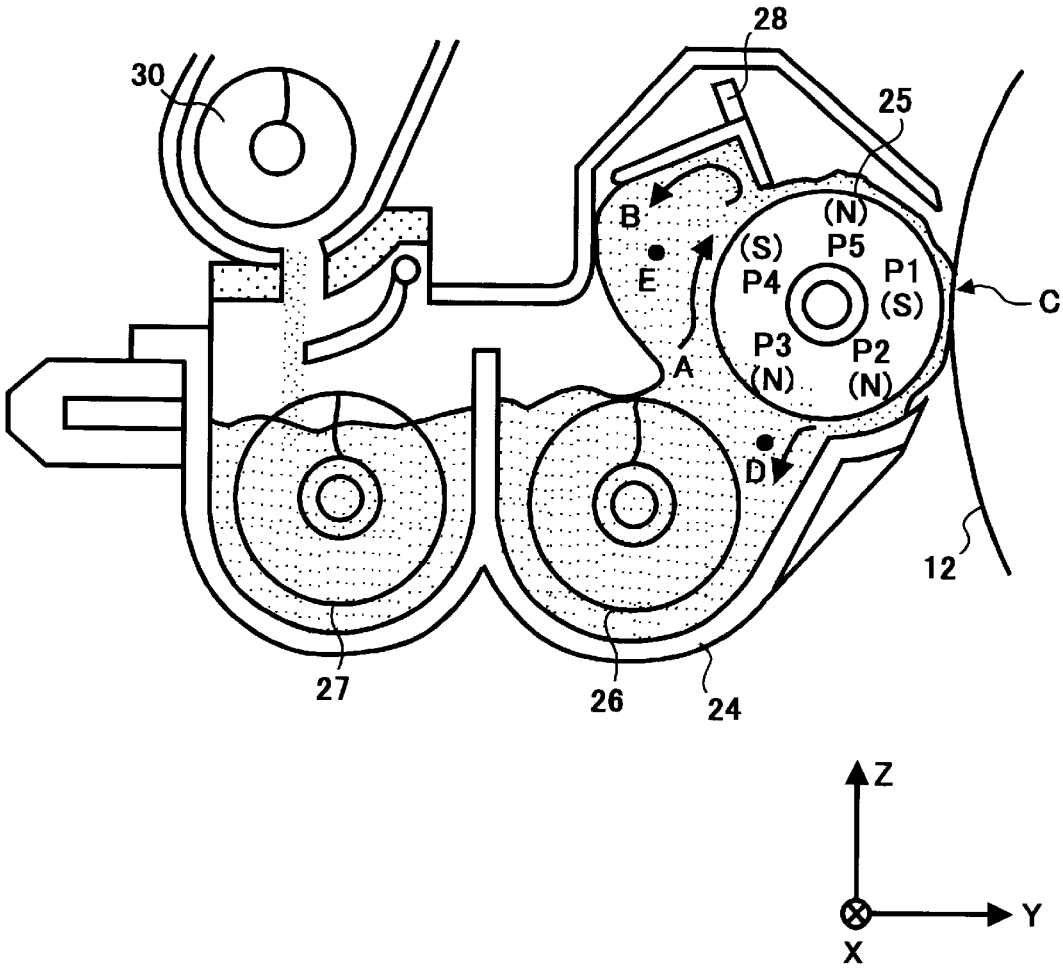
FIG. 4 is a schematic cross-sectional side view showing one of development units included in the multi-color development station of FIG. 2.

The magnet roller of the development roller 25 internally includes magnets and is fixed. Magnetic poles of the above magnets of the magnet roller include poles P1–P5 arranged as shown in FIG. 4. The magnetic pole P1 is referred to as a development pole positioned closest to the image carrying member 12. The magnetic poles P2 and P3 have the same polarity so that the development agent is released from the development roller 25 at an area between the magnetic poles P2 and P3 but is again attracted to the development roller 25 by the magnetic pole P3. The magnetic pole P4 is arranged directly under the doctor blade 28, and a convection space for receiving the development agent is provided at a position upstream from the development doctor 28 in a direction of a flow of the development agent. In the above convection space, the development agent receives more charges by the action of friction so that the development agent rises on the surface of the magnet roller 25 when it is attracted thereto.

Since the first and second transfer screws 26 and 27 are configured to move the development agent in directions different from each other while transferring it toward the development roller 25, the development agent is sufficiently mixed when it reaches the above-mentioned convection space. The development agent thus mixed is moved in a direction A by the magnetic force of the development roller 25 and is regulated by the doctor blade 28 so that an amount of the development agent necessary for the development process is passed through a doctor gap formed between the doctor blade 28 and the surface of the development roller 25. The excess amount of the development agent rejected by doctor blade 28 is returned in a direction B. The development agent passing through the above doctor gap is subjected to the development process at a development position C; that is, the toner included in the development agent is used. The development agent from which the toner is consumed is removed from the development roller 25 in a direction D by forces of magnetic repulsion and gravity. Thus, the development agent, minus the used toner is returned into and is again mixed by the first transfer screw 26 with the fresh development agent which has not yet been used.

If a relatively great amount of toner is used at the development position C by, for example, a solid-colored image, the development agent mainly including the carrier is returned to the fresh development agent and is mixed with it. In this case, if mixing is not made in a sufficient manner, the concentration of toner in the development agent is uneven. If such development agent is transferred by the first transfer screw 26 and is raised in the direction A, the development process performed at the development position C uses an unevenly mixed development agent. This results in an uneven density in an image, typically in a direction relative to a spiral pitch of the first screw 26.

To avoid this phenomenon, in the example being explained, the mixture of the development agent around the development roller 25 is improved. More specifically, the first and second screws 26 and 27 are improved in the mixing performance, particularly, in a transverse (vertical) direction (i.e., a direction Y in FIG. 4) relative to a direction (i.e., a direction X in FIG. 4) in which the development agent is transferred. Such a mixing is referred to as a vertical mixing. In contrast to vertical mixing, the mixing in the direction in which the development agent is transferred is referred to as a horizontal mixing.

Each of the first and second transfer screws 26 and 27 has superior horizontal mixing capabilities but inferior vertical mixing capabilities, and therefore needs to be improved in its vertical mixing ability. For example, the spiral pitch of the transfer screw may be made greater and an angle of the spiral relative to a plane including the shaft of the screw is made smaller. Thereby, the mixing force in the vertical direction (i.e., the direction Y) is increased, relative to the mixing force in the transferring (horizontal) direction (i.e., the direction X). However, such an arrangement causes an extreme reduction of the horizontal mixing. As a result, an image has an uneven density in the direction X in parallel to the length direction of the development roller 25.

Figure 5:
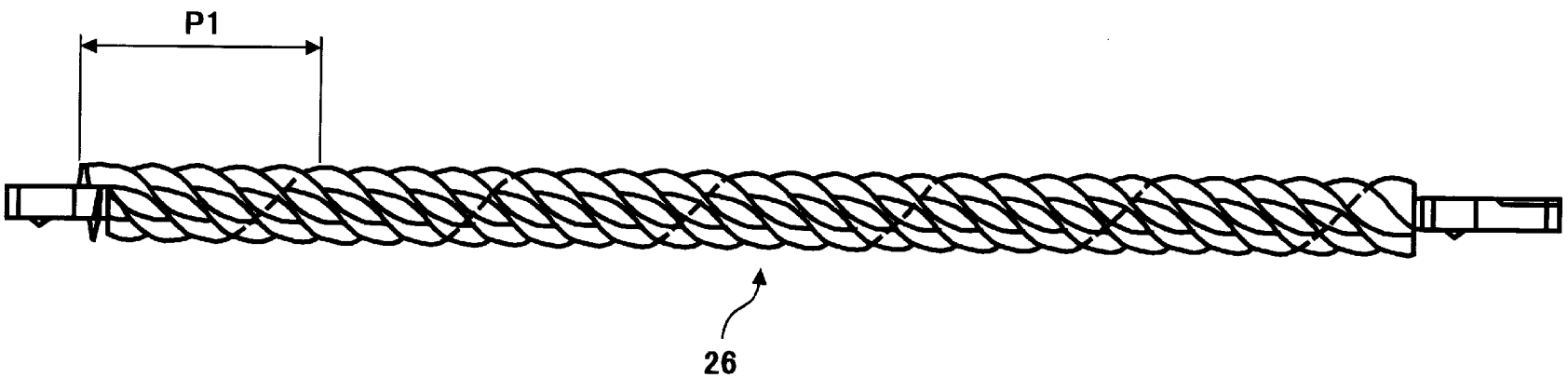
FIG. 5 is a schematic side view showing a first transfer screw included in each of the development units of FIG. 3.

In the example being explained, as shown in FIG. 5, the first transfer screw 26 is configured to have a plurality of spirals, such as five spirals, for example. With this configuration, the horizontal mixing weakened by having the greater spiral pitch is reinforced. At the same time, each spiral is made to have a smaller angle relative to the plane including screw shaft so that the vertical mixing can also be strengthened relative to horizontal mixing in the direction in which the development agent is transferred.

Figure 6:
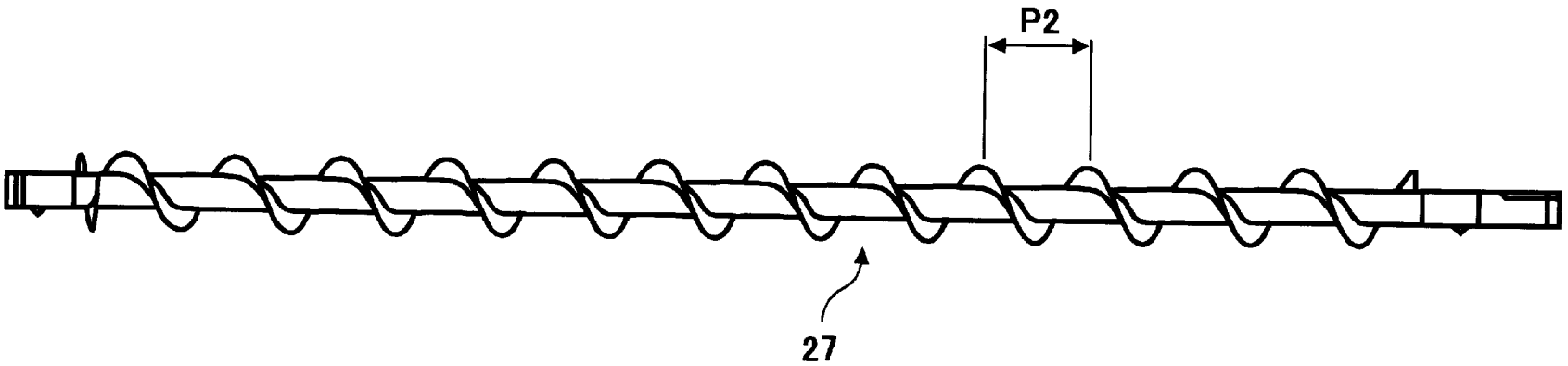
FIG. 6 is a schematic side view showing a second transfer screw included in each of the development units of FIG. 3.

More specifically, the first transfer screw 26 has five screws each having a spiral pitch of 50 mm, as shown in FIG. 5, and the second transfer screw 27 has a single spiral of 25 mm, as shown in FIG. 6. The first and second transfer screws 26 and 27 have the same spiral diameter and the same shaft diameter. In addition, the first and second transfer screws 26 and 27 are rotated to transfer the development agent in directions different from each other.

The first and second transfer screws 26 and 27 have the same spiral diameter and the same shaft diameter, and a screw pitch P1 (see FIG. 5) and a number S1 of spirals of the first transfer screw 26 and a screw pitch (see FIG. 6) and a number S2 of spirals of the second transfer screw 27 satisfy formulas, $$P1 \geqq 1.5 \times P2, \text{ and}$$

$$S1 \geqq 4 \times S2.$$

Accordingly, the first transfer screw 26 thus configured to have the five screws produces the above-described positive effects. However, if the second transfer screw 27 is configured to have a plurality of screws, it becomes difficult to balance the development agent in the direction X in parallel to the length direction of the development roller 25. This would cause a problem such as an uneven density or overflow of the development agent, for example. This is due to interference caused at an area where the development agent is transferred from the second transfer screw 27 to the first transfer screw 26.

That is, the transfer of the development agent from the second transfer screw 27 to the first transfer screw 26 is performed at an end portion thereof in the direction X in parallel to the width direction of the revolving development unit 14, in a manner similar to that of the background art explained with reference to FIG. 6. If each of the first and second transfer screws 26 and 27 is provided with more than one screw, the horizontal mixing is strengthened and therefore the development agent elements are pushed against each other at the above end portion where the transfer occurs. As a result, the transfer is not smoothly performed.

Therefore, in this example, the second transfer screw 27 is provided with a single screw. Such a single screw configuration achieves a sufficient conveyance of the development agent from the second transfer screw 27 to the transfer screw 26 at the leading end portion of the second transfer screw 27 and a sufficient receipt of the development agent at the trailing edge portion of the second transfer screw 27. Thereby, the development units 22*a*–22*d* can effectively perform the circulation of the development agent while improving the vertical mixing at the side of the development roller 25.

Numerous additional modifications and variations of the present application are possible in light of the above teachings. It is therefore to be understood that within the scope of the appended claims, the present application may be practiced otherwise than as specifically described herein.

This application claims priority to Japanese patent application No. JPAP2000-067513 filed on Mar. 10, 2000 in the Japanese Patent Office, the entire contents of which are hereby incorporated by reference.

What is claimed as new and is desired to be secured by Letter Patent of the United States is:

1. An image forming apparatus, comprising:

a development mechanism adapted to perform development of an image using a two component development agent, said development mechanism comprising:

a development roller;

a first transfer screw comprising a first pitch of screw spirals adapted to transfer said development agent from a first end of said first transfer screw to a second end of said first transfer screw and to convey said development agent to said development roller, said first transfer screw being arranged at a position approximately horizontal and in parallel to said development roller; and a second transfer screw comprising a second pitch of screw spirals adapted to transfer said development agent from a first end of said second transfer screw to a second end of said second transfer screw and to convey said development agent from said second end of said second transfer screw to said first end of said first transfer screw, said second transfer screw being arranged at a position approximately horizontal and in parallel to said first transfer screw, wherein said first and second transfer screws are at substantially the same horizontal level, wherein said first and second pitches of said screw spirals are different from each other, and wherein said first and second transfer screws are separated by individual chambers with a wall therebetween, and said development agent is transferred from said second transfer screw to said first transfer screw at edge portions of said first and second transfer screws.

2. An image forming apparatus as defined in claim 1, wherein said first pitch of said screw spirals is greater than said second pitch of said screw spirals.

3. An image forming apparatus as defined in claim 1, wherein said first transfer screw has a first spiral pitch which is greater than a second spiral pitch of said second transfer screw.

4. An image forming apparatus, comprising:

a development mechanism adapted to perform development of an image using a two component development agent, said development mechanism comprising:

a development roller;

a first transfer screw comprising a first number of screw spirals adapted to transfer said development agent from a first end of said first transfer screw to a second end of said first transfer screw and to convey said development agent to said development roller, said first transfer screw being arranged at a position approximately horizontal and in parallel to said development roller; and a second transfer screw comprising a second number of screw spirals adapted to transfer said development agent from a first end of said second transfer screw to a second end of said second transfer screw and to convey said development agent from said second end of said second transfer screw to said first end of said first transfer screw, said second transfer screw being arranged at a position approximately horizontal and in parallel to said first transfer screw, wherein said first and second numbers of said screw spirals are different from each other, wherein when said first and second transfer screws have spiral diameters equal to each other and shaft diameters equal to each other, wherein said first and second transfer screws satisfy relationships of:

$P1\ 1.5 \times P2$; and $S1\ 4 \times S2$, wherein P1 and S1 represent a first spiral pitch and said first screw spirals, respectively, of said first transfer screw and P2 and S2 represent a second spiral pitch and said second screw spirals, respectively, of said second transfer screw, wherein said first and second transfer screws are separated by individual chambers with a wall therebetween, and said development agent is transferred from said second transfer screw to said first transfer screw at edge portions of said first and second transfer screws.

5. An image forming apparatus as defined in claim 1, wherein said first and second transfer screws are rotated in directions different from each other.

6. An image forming apparatus, comprising:

developing means for developing an image using a two component development agent, said developing means comprising:

a developing roller;

first transfer screw means for transferring the development agent, comprising a first pitch of screw spiral means for transferring said development agent from a first end of said first transfer screw means to a second end of said first transfer screw means and for conveying said development agent to said developing roller means, said first transfer screw means being horizontally arranged in parallel to said developing roller means; and second transfer screw means for transferring the development agent, comprising a second pitch of screw spiral means for transferring said development agent from a first end of said second transfer screw means to a second end of said second transfer screw means and for conveying said development agent from said second end of said second transfer screw means to said first end of said first transfer screw means, said second transfer screw means being horizontally arranged in parallel to said first transfer screw means, wherein said first and second transfer screws are at substantially the same horizontal level, and wherein said first and second pitches of said screw spiral means are different from each other, and wherein said first and second transfer screws are separated by individual chambers with a wall therebetween, and said development agent is transferred from said second transfer screw to said first transfer screw at edge portions of said first and second transfer screws.

7. An image forming apparatus as defined in claim 6, wherein said first pitch of said screw spiral means is greater than said second pitch of said screw spiral means.

8. An image forming apparatus as defined in claim 6, wherein said first transfer screw means has a first spiral pitch which is greater than a second spiral pitch of said second transfer screw means.

9. An image forming apparatus, comprising:

developing means for developing an image using a two component development agent, said developing means comprising:

a developing roller;

first transfer screw means for transferring the development agent, comprising a first number of screw spiral means for transferring said development agent from a first end of said first transfer screw means to a second end of said first transfer screw means and for conveying said development agent to said developing roller means, said first transfer screw means being horizontally arranged in parallel to said developing roller means; and second transfer screw means for transferring the development agent, comprising a second number of screw spiral means for transferring said development agent from a first end of said second transfer screw means to a second end of said second transfer screw means and for conveying said development agent from said second end of said second transfer screw means to said first end of said first transfer screw means, said second transfer screw means being horizontally arranged in parallel to said first transfer screw means, wherein said first and second numbers of said screw spiral means are different from each other, wherein when said first and second transfer screw means have spiral diameters equal to each other and shaft diameters equal to each other, said first and second transfer screw means satisfy relationships of:

$P1\ 1.5 \times P2$; and $S1\ 4 \times S2$, wherein P1 and S1 represent a first spiral pitch and said first screw spirals, respectively, of said first transfer screw means and P2 and S2 represent a second spiral pitch and said second screw spirals, respectively, of said second transfer screw means, and wherein said first and second transfer screws are separated by individual chambers with a wall therebetween, and said development agent is transferred from said second transfer screw to said first transfer screw at edge portions of said first and second transfer screws.

10. An image forming apparatus as defined in claim 6, wherein said first and second transfer screw means are rotated in directions different from each other.

11. A method of transferring development agent, comprising the steps of:

providing a first transfer screw at a position approximately horizontal and in parallel to a developing roller, said first transfer screw having a first pitch of screw spirals;

placing a second transfer screw at a position approximately horizontal and in parallel to said first transfer screw, said second transfer screw having a second pitch of screw spirals, said first and second transfer screws being at substantially the same horizontal level, and said second pitch of screw spirals being different from said first pitch of screw spirals;

rotating said first transfer screw; and reverse rotating said second transfer screw in a reverse direction relative to the rotation of said first transfer screw to transfer said development agent in a direction from a first end of said second transfer screw to a second end of said second transfer screw and in a direction from said second transfer screw to said first transfer screw so that said development agent is consequently transferred by said first transfer screw in a direction from a first end of said first transfer screw to a second end of said first transfer screw and in a direction from said first transfer screw to said development roller, wherein said first and second transfer screws are separated by individual chambers with a wall therebetween, and said development agent is transferred from said second transfer screw to said first transfer screw at edge portions of said first and second transfer screws.

12. A method as defined in claim 11, wherein said first pitch of said screw spirals is greater than said second pitch of said screw spirals.

13. A method as defined in claim 11, wherein said first transfer screw has a first spiral pitch which is greater than a second spiral pitch of said second transfer screw.

14. A method of transferring development agent, comprising the steps of:

providing a first transfer screw at a position approximately horizontal and in parallel to a developing roller, said first transfer screw having a first pitch of screw spirals;

placing a second transfer screw at a position approximately horizontal and in parallel to said first transfer screw, said second transfer screw having a second pitch of screw spirals, said second pitch of screw spirals being different from said first pitch of screw spirals;

rotating said first transfer screw; and reverse rotating said second transfer screw in a reverse direction relative to the rotation of said first transfer screw to transfer said development agent in a direction from a first end of said second transfer screw to a second end of said second transfer screw and in a direction from said second transfer screw to said first transfer screw so that said development agent is consequently transferred by said first transfer screw in a direction from a first end of said first transfer screw to a second end of said first transfer screw and in a direction from said first transfer screw to said development roller, wherein when said first and second transfer screws have spiral diameters equal to each other and shaft diameters equal to each other, said first and second transfer screws satisfy relationships of:

$$P1\ 1.5 \times P2; \text{ and}$$

$$S1\ 4 \times S2,$$

wherein P1 and S1 represent a first spiral pitch and said first screw spirals, respectively, of said first transfer screw and P2 and S2 represent a second spiral pitch and said second screw spirals, respectively, of said second transfer screw, wherein said first and second transfer screws are separated by individual chambers with a wall therebetween, and said development agent is transferred from said second transfer screw to said first transfer screw at edge portions of said first and second transfer screws.

15. A method as defined in claim 11, wherein said first and second transfer screws are rotated in directions different from each other.

* * * * *